US009253575B2

(12) United States Patent
Chen et al.

(10) Patent No.: US 9,253,575 B2
(45) Date of Patent: Feb. 2, 2016

(54) POWER MANAGEMENT SYSTEM AND METHOD THEREOF

(71) Applicant: Anpec Electronics Corporation, Hsin-Chu (TW)

(72) Inventors: Ke-Horng Chen, Hsinchu (TW); Shen-Yu Peng, Hsinchu County (TW); Shin-Hao Chen, Taichung (TW); Yi-Ping Su, New Taipei (TW); Yuan-Hung Wang, Miaoli County (TW); Te-Sheng Chen, Miaoli County (TW); Yun-Li Liu, Taichung (TW)

(73) Assignee: Anpec Electronics Corporation, Hsinchu Science Park, Hsin-Chu (TW)

( * ) Notice: Subject to any disclaimer, the term of this patent is extended or adjusted under 35 U.S.C. 154(b) by 0 days.

(21) Appl. No.: 14/264,021

(22) Filed: Apr. 28, 2014

(65) Prior Publication Data

US 2015/0264456 A1 Sep. 17, 2015

(30) Foreign Application Priority Data

Mar. 13, 2014 (TW) ..... 103109133 A

(51) Int. Cl.
*H04R 5/04* (2006.01)
*H04R 31/00* (2006.01)

(52) U.S. Cl.
CPC ..... *H04R 5/04* (2013.01); *H04R 2430/00* (2013.01)

(58) Field of Classification Search
CPC ..... H04R 3/002; H04R 29/001; H04R 3/007; H04R 1/00; H04R 2430/00; H04R 2430/01; H04R 2430/03
See application file for complete search history.

(56) References Cited

U.S. PATENT DOCUMENTS

2011/0228945 A1* 9/2011 Mihelich et al. ..... 381/59
2012/0134517 A1* 5/2012 Sato ..... 381/150
2014/0219465 A1* 8/2014 Saideh ..... 381/74

* cited by examiner

*Primary Examiner* — Fan Tsang
*Assistant Examiner* — Angelica M McKinney
(74) *Attorney, Agent, or Firm* — Winston Hsu; Scott Margo

(57) ABSTRACT

A power management system coupled to a speaker module includes a monitor module for measuring a current signal and a voltage signal of the speaker module to obtain a real-time impedance information of the speaker module; a reception module for receiving a time-domain audio analogy signal to be transformed into a frequency-domain audio digital signal; a prediction module for generating a power prediction information according to an initial audio information, the real-time impedance information and the audio digital signal; a control module for generating a control signal according to the audio digital signal and a human hearing model information; and a power adjustment module for outputting an adjustment audio signal to the speaker module according to the power prediction information, the audio digital signal and the control signal, so as to perform a broadcast operation of the speaker module.

10 Claims, 5 Drawing Sheets

POWER MANAGEMENT SYSTEM AND METHOD THEREOF

BACKGROUND OF THE INVENTION

1. Field of the Invention

The present invention relates to a power management system and method thereof, and more particularly, to a power management system and method thereof which can measure a real-time impedance information of a speaker module and adaptively control the power.

2. Description of the Prior Art

As technology advances, personal module devices and household televisions have been developed to have higher output power and better music quality of speaker modules. Especially for those thinner/lighter mobile devices, an output efficiency of the installed speaker module has been seriously focused on by the industry. Traditionally, if the speaker module is necessary to output higher decibel (dB) volume, a common solution may be increasing an output voltage of the speaker module or lowering a corresponding impedance of the speaker module. Since sizes of the speaker modules installed inside the module devices may be small, playing higher dB volume of an audio signal may result in generating a larger passing current or a higher temperature of the speaker module, such that rubber coating of an internal coil of the speaker module may melt. When a user wants to play intensively mega bass, a drum coating of the speaker module may also be loosened or broken due to excessive vibration of the drum membrane, which can restrict operations of the user.

Therefore, it has been an important issue to provide a power management system and method thereof to adaptively measure a real-time impedance information of a speaker module and adaptively control the power to correspondingly output higher dB volume of an audio signal without sacrificing quality thereof, so as to maintain functional operations of the speaker module.

SUMMARY OF THE INVENTION

It is the object of the invention to provide a power management system and method thereof to adaptively measure a real-time impedance information of a speaker module and adaptively control the power.

According to an aspect of the disclosure, a power management system coupled to a speaker module is provided. The power management system comprises a monitor module, for measuring a current signal and a voltage signal corresponding to the speaker module to obtain a real-time impedance information corresponding to the speaker module; a reception module, for receiving an audio analogy signal to be transformed into an audio digital signal, wherein the audio analogy signal is a time-domain signal and the audio digital signal is a frequency-domain signal; a prediction module, coupled to the monitor module and the reception module and predetermined an initial audio information, for generating a power prediction information according to the initial audio information, the real-time impedance information and the audio digital signal; a control module, coupled to the reception module and predetermined a human hearing model information, for generating a control signal according to the audio digital signal and the human hearing model information; and a power adjustment module, coupled to the prediction module, the reception module and the control module, for correspondingly outputting an adjustment audio signal to the speaker module according to the power prediction information, the audio digital signal and the control signal, so as to perform a broadcast operation of the speaker module.

According to another aspect of the disclosure, a power management method for a power management system coupled to a speaker module is provided. The power management method comprises measuring a current signal and a voltage signal corresponding to the speaker module to obtain a real-time impedance information corresponding to the speaker module; receiving an audio analogy signal to be transformed into an audio digital signal, wherein the audio analogy signal is a time-domain signal and the audio digital signal is a frequency-domain signal; generating a power prediction information according to an initial audio information, the real-time impedance information and the audio digital signal; generating a control signal according to the audio digital signal and a human hearing model information; and outputting an adjustment audio signal to the speaker module according to the power prediction information, the audio digital signal and the control signal, to perform a broadcast operation of the speaker module.

These and other objectives of the present invention will no doubt become obvious to those of ordinary skill in the art after reading the following detailed description of the preferred embodiment that is illustrated in the various figures and drawings.

DETAILED DESCRIPTION

The specification and the claims of the present invention may use a particular word to indicate an element, which may have diversified names named by distinct manufacturers. The present invention distinguishes the element depending on its function rather than its name. The phrase "comprising" used in the specification and the claim is to mean "is inclusive or open-ended but not exclude additional, un-recited elements or method steps." In addition, the phrase "electrically connected to" or "coupled" is to mean any electrical connection in a direct manner or an indirect manner. Therefore, the description of "a first device electrically connected or coupled to a second device" is to mean that the first device is connected to the second device directly or by means of connecting through other devices or methods in an indirect manner.

Figure 1:
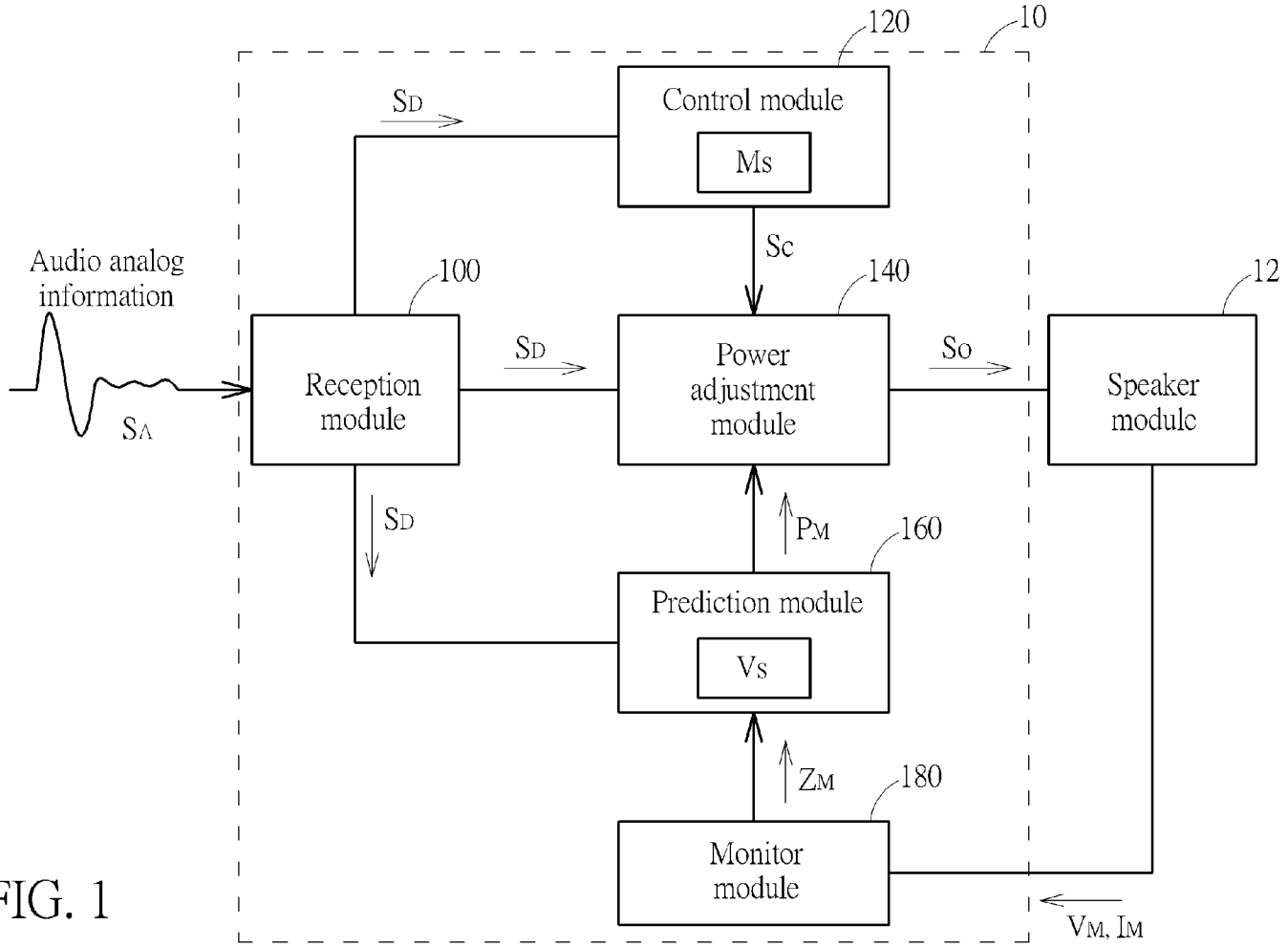
FIG. 1 illustrates a schematic diagram of a power management system according to an embodiment of the invention.

Please refer to FIG. 1, which illustrates a schematic diagram of a power management system 10 according to an embodiment of the invention. As shown in FIG. 1, the power management system 10 of the embodiment is coupled to a speaker module 12, and comprises a reception module 100, a control module 120, a power adjustment module 140, a prediction module 160 and a monitor module 180. The reception module 100 is coupled to the control module 120, the power adjustment module 140 and the prediction module 160. The prediction module 160 is coupled to the monitor module 180, and the monitor module 180 is further coupled to the speaker module 12. The speaker module 12 is called a loudspeaker, and is well-known to those skilled in the art to comprise a magnet, a coil and a speaker body. Due to electromagnetic sensing effect between the magnet and the coil being conducted, vibration of a drum membrane of the speaker body is generated to press the air for generating an audio signal. Since the speaker module 12 is not the main scope of the invention, related operations of the speaker module 12 are not detailed described herein for brevity.

Figure 2:
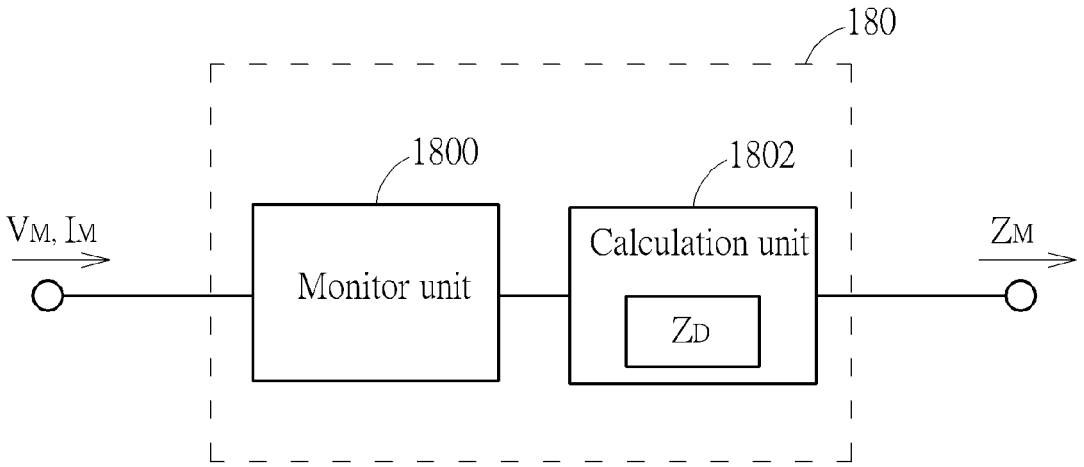
FIG. 2 illustrates a detailed schematic diagram of a monitor module according to an embodiment of the invention.

In the embodiment, the reception module 100 receives an external audio analog information $S_A$ to be transformed into an audio digital signal $S_D$ and for being transmitted to the control module 120, the power adjustment module 140 and the prediction module 160, wherein the audio analogy signal $S_A$ is a time-domain signal and the audio digital signal $S_D$ is a frequency-domain signal. The audio digital signal $S_D$ comprises different voltage values corresponding to a plurality of audio signals at a plurality of frequency bands. Please refer to FIG. 2, which illustrates a detailed schematic diagram of a monitor module 180 according to an embodiment of the invention. As shown in FIG. 2, the monitor module 180 of the embodiment can be realized via a plurality of universal serial bus (USB) sound cards and a plurality of analog-to-digital converters. For different realizations, the monitor module 180 of the embodiment can be simplified to comprise a monitor unit 1800 and a calculation unit 1802. The monitor 1800 is coupled to the speaker module 12 to detect a current signal $I_M$ and a voltage signal $V_M$ of the speaker module 12, such that the monitor module 1800 can obtain a real-time loading power information corresponding to the speaker module 12. The calculation unit 1802 is coupled to the monitor unit 1800, and predetermines a Z-transformation information $Z_D$, wherein the Z-transformation information $Z_D$ is a look-up table of instructions for transforming a series of discrete real numbers or complex numbers from a time-domain representation to a frequency-domain representation. Accordingly, the calculation unit 1802 generates the real-time impedance information $Z_M$ of the speaker module 12 to be transmitted to the prediction module 160 according to the Z transformation information $Z_D$, the current signal $I_M$ and the voltage signal $V_M$. Under such circumstances, after the speaker module 12 has initiated, the monitor module 180 correspondingly obtains the current signal $I_M$ and the voltage signal $V_M$ of the speaker module 12 and transmits the real-time impedance information $Z_M$ to the prediction module 160.

Figure 3:
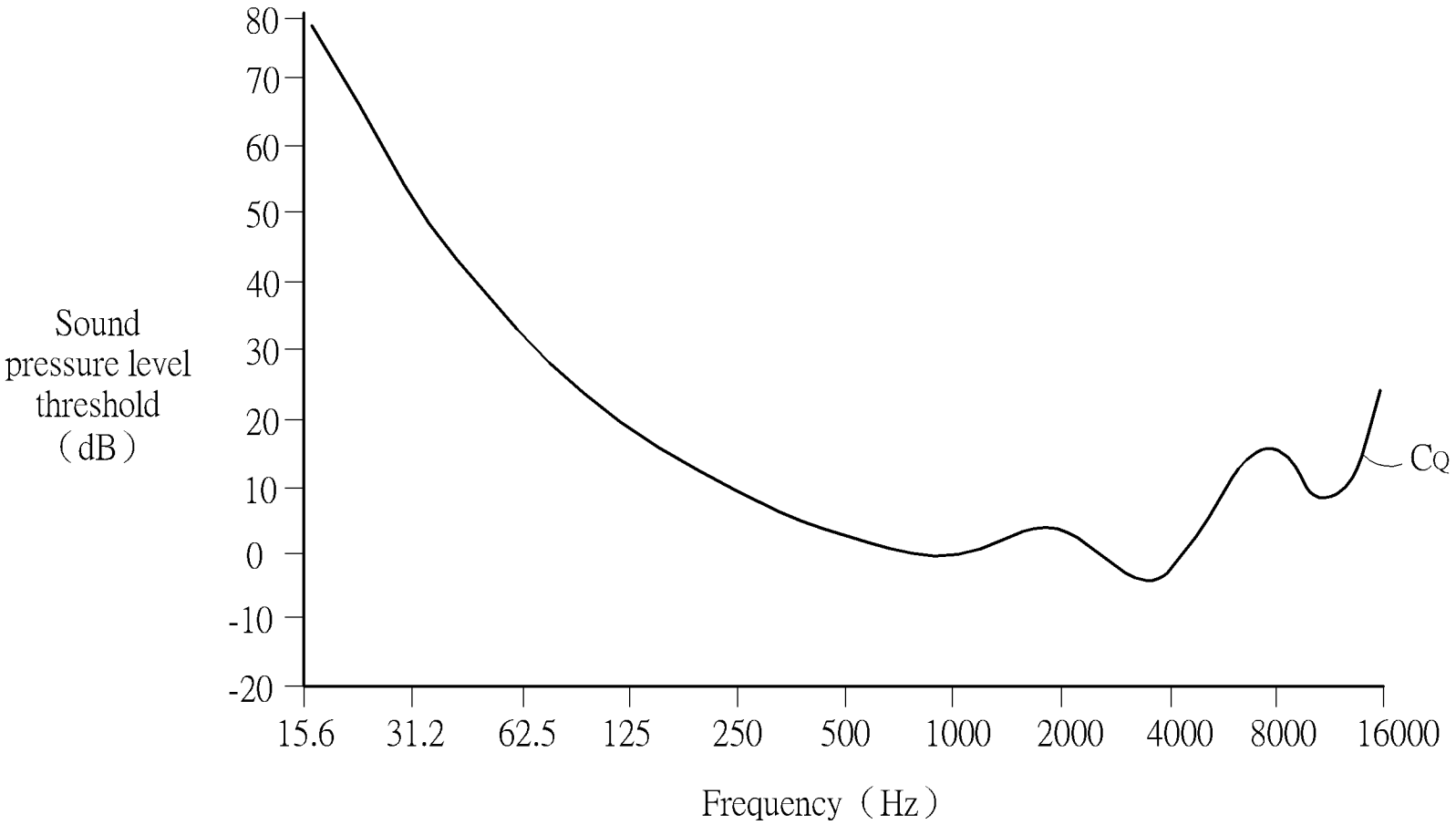
FIG. 3 illustrates a schematic diagram of a human hearing model information according to an embodiment of the invention.

Please refer to FIG. 1 again, the prediction module 160 of the embodiment predetermines an initial audio information $V_S$, such as a minimum voltage signal for triggering the speaker module 12, and accordingly, the prediction module 160 generates a power prediction information $P_M$ to be transmitted to the power adjustment module 140 according to the audio digital signal $S_D$ and the real-time impedance information $Z_M$. Besides, the control module 120 predetermines a human hearing model information $M_S$ and generates a control signal $S_C$ to be transmitted to the power adjustment module 140 according to the audio digital signal $S_D$ and the human hearing model information $M_S$ In the embodiment, the human hearing model information $M_S$ comprises a plurality of sound pressure level thresholds corresponding to a plurality of frequency bands within a normal human hearing range. As shown in FIG. 3, a curve $C_Q$ can be utilized to represent a lowest hearable sound pressure level threshold (having dB as a unit) at different frequency bands in a completely quiet/silent situation, and the plurality of frequency bands of the embodiment are within a frequency range from 20 Hertz (Hz) to 20 KHz to be unequally divided into 24 frequency bands and each band can be a range from 100 Hz to 16.55 KHz, which is only for demonstration without limiting the scope of the invention.

Moreover, the control signal $S_C$ generated by the control module 120 can be utilized to set a plurality of weight values corresponding to the plurality of sound pressure level thresholds at different frequency bands, and cooperates with generation of the Masking Effects associated with neighboring frequency bands. The Masking Effects is understood as eliminating lower power value frequency bands to be masked and keeping higher power value frequency bands, to reduce distortion effects of the audio signal for displaying/broadcasting the audio signals as the one being just received (i.e. the human ear may not be susceptible to the adjusted audio signals/timbre to be eliminated at the lower power value frequency bands), so as to make the speaker module 12 be operated in a high output power mode. In comparison with the prior art, the embodiment of the invention makes the user feel the speaker module 12 delivering pseudo high power as being operated in the high output power mode while the user hears/receives the audio signals. Under such circumstances, the control module 120 of the embodiment compares the plurality of power values corresponding to different frequency bands of the audio digital signal $S_D$ and the plurality of sound pressure level thresholds corresponding to different frequency bands of the human hearing model information $M_S$, to correspondingly output the control signal $S_C$ (i.e. adjusting the plurality of weight values corresponding to the different sound pressure level thresholds) to the power adjustment module 140. Accordingly, the power adjustment module 140 of the embodiment correspondingly adjusts and sums the plurality of power values of the audio digital signal $S_D$ at different frequency bands according to the audio digital signal $S_D$, the control signal $S_C$ and the power prediction information $P_M$, to output an adjustment audio signal $S_O$, such as a voltage signal or a current signal without amplifying, to the speaker module 12, such that the speaker module 12 is triggered by the adjustment audio signal $S_O$ to process a broadcast operation.

For example, when the audio digital signal $S_D$ comprises an audio signal of 15 KHz corresponding to an over-high power value (i.e. being larger than the corresponding sound pressure level threshold, and in detail, according to the real-time impedance information $Z_M$ measured by the monitor module 180, the power value is calculated by the prediction module 160 to be the power prediction information $P_M$). Under such circumstances, the control module 120 can further set the control signal $S_C$ to make the power adjustment module 140 multiply the audio signal of 15 KHz with an adjustment weight value as 0.8 for outputting the adjustment audio signal $S_O$, so as to avoid damages of the speaker module 12. Tones that are close to the high power tone can be ignored since their power values are beneath the masking curve, which is generated by the high power tone. In other words, the weaker sounds (i.e. low power tones) are masked and inaudible in the presence of a louder sound (i.e. the high power tone). Accordingly, the lower power tones can be taken off to get high efficiency.

Certainly, the control module 120 of the embodiment can be coupled to other function setting modules according to different embodiments or requirements of the user (e.g. the user can adaptively select different playing situation modes). Accordingly, the user can utilize a setting signal generated by the function setting module to set a current playing situation mode, and the control module 120 can refer to the current audio digital signal $S_D$, the human hearing model information $M_S$ and the setting signal to corresponding set the control signal $S_C$ for adjusting the plurality of weight values corresponding to different power values of the audio signal at different frequency bands, so as to control the power adjustment module 140 for outputting the adjustment audio signal $S_O$ without distortion, which is also in the scope of the invention.

In brief, the power management system 10 of the embodiment utilizes the monitor module 180 to instantaneously measure the real-time impedance information $Z_M$ of the speaker module 12, and utilizes the human hearing model information $M_S$ predetermined by the control module 120 to adaptively adjust the weight values corresponding to the power values of the audio signal at different frequency bands. Then, the power adjustment module 140 outputs the adjustment audio signal to the speaker module 12 to avoid a situation of operating the speaker module 12 having a larger current or a higher temperature, so as to improve convenience of the user operating the speaker module 12 at different playing situation modes.

Figure 4:
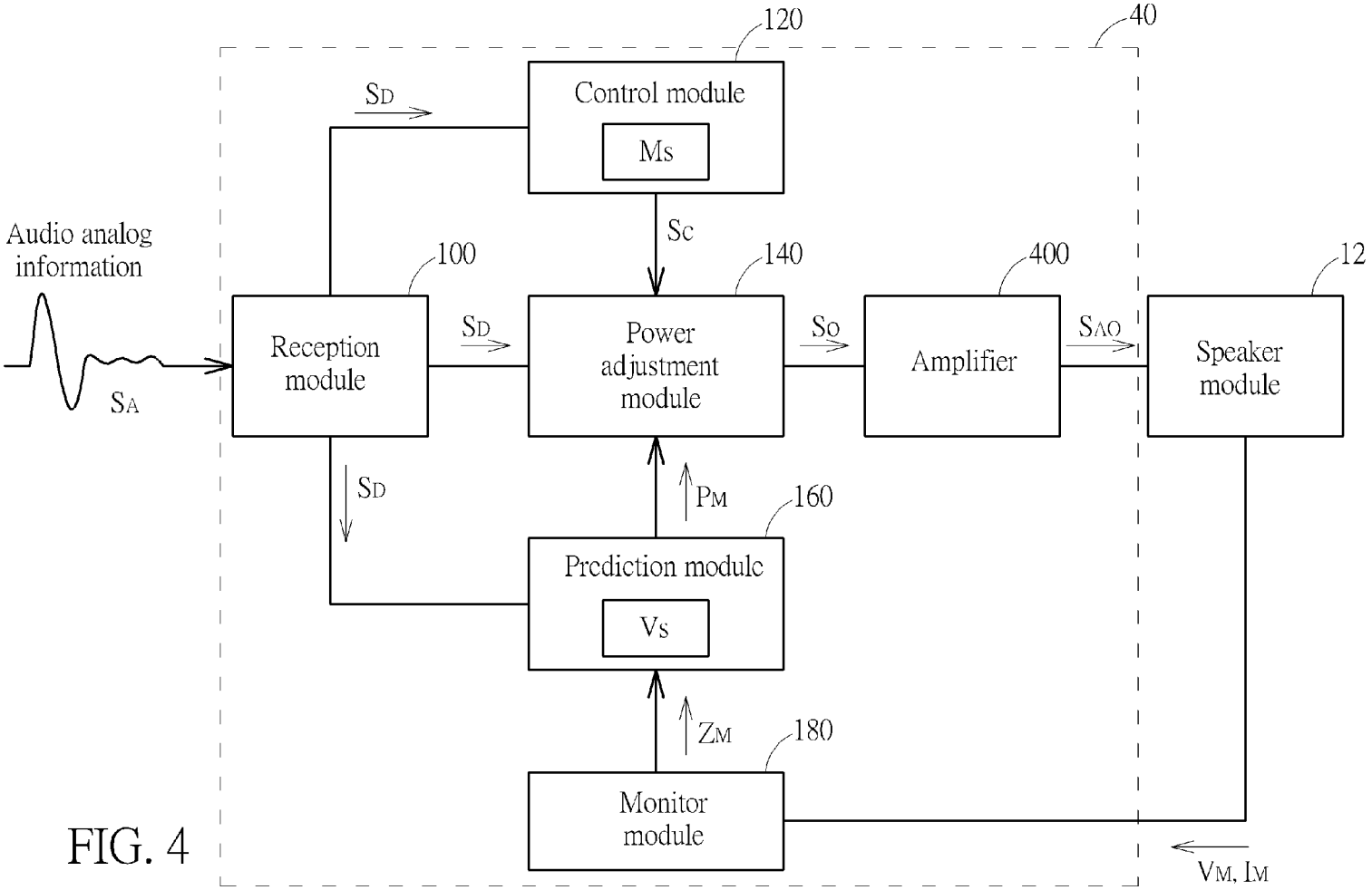
FIG. 4 illustrates a schematic diagram of another power management system according to an embodiment of the invention.

Furthermore, please refer to FIG. 4, which illustrates a schematic diagram of another power management system 40 according to an embodiment of the invention. As shown in FIG. 4, the power management system 40 is similar to the power management system 10 to have the similar composition elements/units and related operations thereof, and further comprises an amplifier 400 coupled between the speaker module 12 and the power adjustment module 140. In the embodiment, the amplifier 400 can be a class-D amplifier. After the adjustment audio signal $S_O$ outputted by the power adjustment module 140 enters the amplifier 400, the amplifier 400 can adjust a power value of the adjustment audio signal $S_O$ to be amplified as an amplified adjustment audio signal $S_{AO}$ for being transmitted to the speaker module 12, so as to comply with requirements of different mobile devices, tablets or high-output-power speaker devices coupled to the power management system 40, which is also in the scope of the invention.

Figure 5:
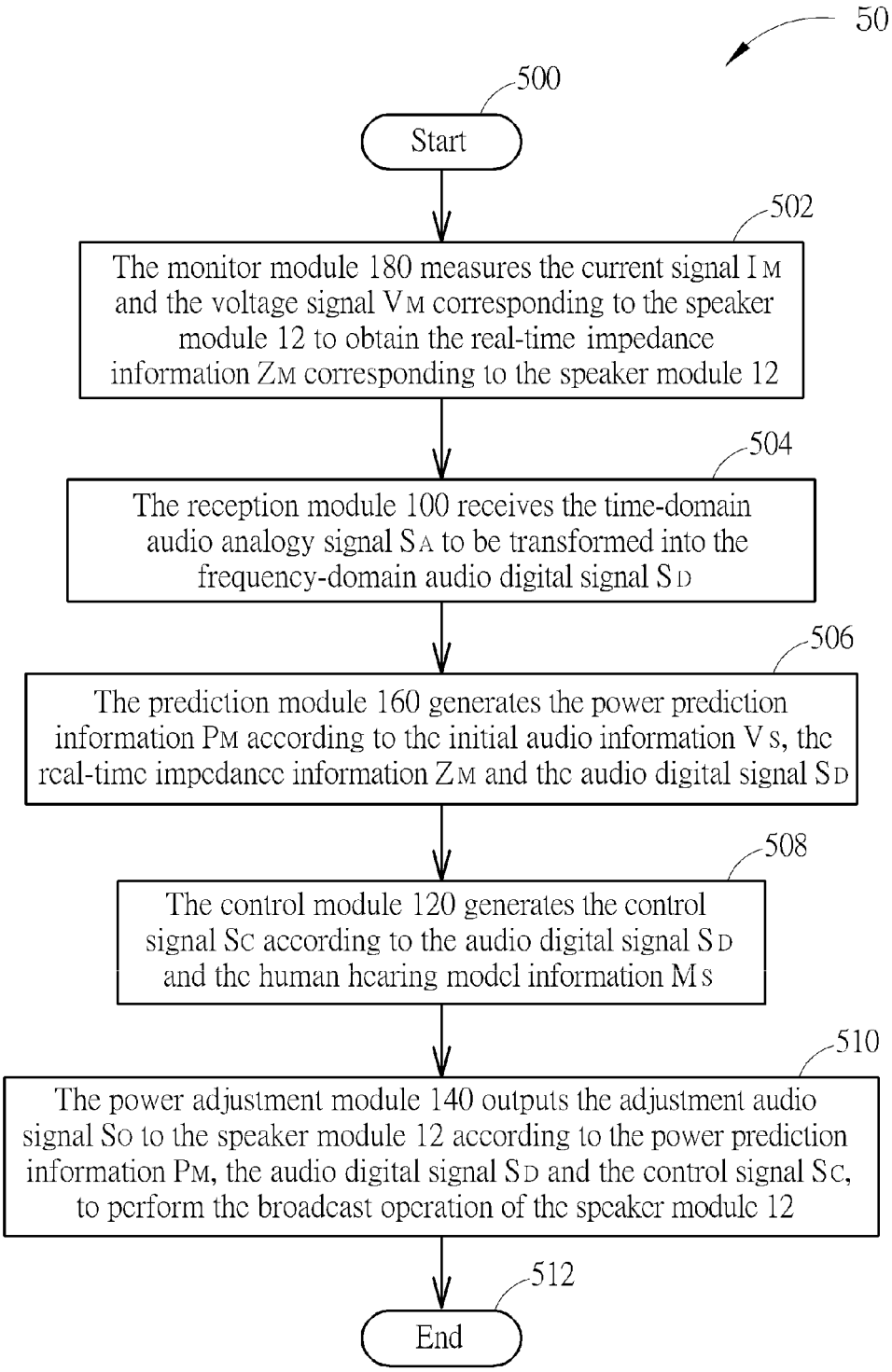
FIG. 5 illustrates a flow chart of a power management process according to an embodiment of the invention.

Further, power management operations of the power management system 10 (or the power management system 40) can be summarized as a power management process 50, as shown in FIG. 5. The power management process 50 includes the following steps:

Step 500: Start.

Step 502: The monitor module 180 measures the current signal $I_M$ and the voltage signal $V_M$ corresponding to the speaker module 12 to obtain the real-time impedance information $Z_M$ corresponding to the speaker module 12.

Step 504: The reception module 100 receives the time-domain audio analogy signal $S_A$ to be transformed into the frequency-domain audio digital signal $S_D$.

Step 506: The prediction module 160 generates the power prediction information $P_M$ according to the initial audio information $V_S$, the real-time impedance information $Z_M$ and the audio digital signal $S_D$.

Step 508: The control module 120 generates the control signal $S_C$ according to the audio digital signal $S_D$ and the human hearing model information $M_S$.

Step 510: The power adjustment module 140 outputs the adjustment audio signal $S_O$ to the speaker module 12 according to the power prediction information $P_M$, the audio digital signal $S_D$ and the control signal $S_C$, to perform the broadcast operation of the speaker module 12.

Step 512: End.

Detailed operations of each of the steps in the power management process 50 can be understood via the power management system 10 and related paragraphs thereof, which is not repeated hereinafter for brevity. Preferably, operational periods of step 502 and step 504 of the embodiment can be adaptively interchanged, i.e. the purpose of the invention is to obtain the real-time impedance information $Z_M$ of the speaker module 12 by the monitor module 180 after initiation of the speaker module 12 and before generation of the power prediction information $P_M$ by the prediction module 160, which is not limiting the scope of the invention. Step 508 can be amended to cooperate with other setting operations of other function setting modules, which means that the control module 120 can simultaneously refer to the audio digital signal $S_D$, the human hearing model information $M_S$ and the setting signals of the function setting module to generate the control signal $S_C$. Step 510 can also be modified to integrate the operations of the amplifier 400, which is also in the scope of the invention.

In summary, embodiments of the invention provide a power management system and method thereof. By measuring, via the monitor module, the real-time loading power information of the speaker module and utilizing the predetermined human hearing model information of the control module, the embodiments of the invention can adaptively compare differences between the audio input signal and the human hearing model information to correspondingly adjust the weight values of the audio signal at different frequency bands. Accordingly, the power adjustment module outputs the adjustment audio signal to the speaker module to avoid the speaker module being operated in situations of higher temperature or larger current. Also, the embodiments of the invention can also integrate different function setting modules, such that the mobile devices, the tablets or the high-output-power speaker devices coupled to the power management system can be adaptively operated in different playing situation modes for improving operational convenience of the user.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A power management system coupled to a speaker module, the power management system comprising:

a monitor module, configured to measure a current signal and a voltage signal corresponding to the speaker module to obtain a real-time impedance information corresponding to the speaker module;

a reception module, configured to receive an audio analogy signal to be transformed into an audio digital signal, wherein the audio analogy signal is a time-domain signal and the audio digital signal is a frequency-domain signal;

a prediction module, coupled to the monitor module and the reception module and predetermined an initial audio information, configured to generate a power prediction information according to the initial audio information, the real-time impedance information and the audio digital signal;

a control module, coupled to the reception module and predetermined a human hearing model information, configured to generate a control signal according to the audio digital signal and the human hearing model information; and a power adjustment module, coupled to the prediction module, the reception module and the control module, configured to correspondingly output an adjustment audio signal to the speaker module according to the power prediction information, the audio digital signal and the control signal, so as to perform a broadcast operation of the speaker module.

2. The power management system of claim 1, wherein the monitor module comprises:

a monitor unit, coupled to the speaker module, configured to measure the current signal and the voltage signal of the speaker module to obtain a real-time loading power information of the speaker module; and a calculation unit, coupled between the monitor unit and the prediction module, configured to generate the real-time impedance information of the speaker module according to the current signal, the voltage signal and a Z-transformation information, to transmit the real-time impedance information to the prediction module.

3. The power management system of claim 1, wherein the power adjustment module processes a power adjustment operation at a frequency domain, wherein the frequency domain comprises a plurality of frequency bands and the audio digital signal comprises a plurality of sound pressure level thresholds corresponding to the plurality of frequency bands, such that while processing the power adjustment operation, the power adjustment module correspondingly adjusts the plurality of sound pressure level thresholds according to the control signal, to generate the adjustment audio signal to be transmitted to the speaker module.

4. The power management system of claim 1, further comprising an amplifier, coupled between the power adjustment module and the speaker module, for amplifying the adjustment audio signal, such that the speaker module processes the broadcast operation after receiving the amplified adjustment audio signal.

5. The power management system of claim 3, wherein the control module refers to the human hearing model information and the audio digital signal at the plurality of frequency bands, to determine a plurality of weight values corresponding to the plurality of sound pressure level thresholds, so as to correspondingly output the control signal to the power adjustment module for generating the adjustment audio signal.

6. A power management method for a power management system coupled to a speaker module, the power management method comprising:

measuring a current signal and a voltage signal corresponding to the speaker module to obtain a real-time impedance information corresponding to the speaker module;

receiving an audio analogy signal to be transformed into an audio digital signal, wherein the audio analogy signal is a time-domain signal and the audio digital signal is a frequency-domain signal;

generating a power prediction information according to an initial audio information, the real-time impedance information and the audio digital signal;

generating a control signal according to the audio digital signal and a human hearing model information; and outputting an adjustment audio signal to the speaker module according to the power prediction information, the audio digital signal and the control signal, to perform a broadcast operation of the speaker module.

7. The power management method of claim 6, further comprising generating the real-time impedance information of the speaker module according to the current signal, the voltage signal and a Z-transformation information.

8. The power management method of claim 6, further comprising processing a power adjustment operation at a frequency domain, wherein the frequency domain comprises a plurality of frequency bands and the audio digital signal comprises a plurality of sound pressure level thresholds corresponding to the plurality of frequency bands, to adjust the plurality of sound pressure level thresholds according to the control signal while processing the power adjustment operation, so as to generate the adjustment audio signal to be transmitted to the speaker module.

9. The power management method of claim 6, further comprising utilizing an amplifier for amplifying the adjustment audio signal, such that the speaker module processes the broadcast operation after receiving the amplified adjustment audio signal.

10. The power management method of claim 8, further comprising referring to the human hearing model information and the audio digital signal at the plurality of frequency bands, to determine a plurality of weight values corresponding to the plurality of sound pressure level thresholds.

* * * * *